United States Patent [19]

Shannon et al.

[11] Patent Number: 4,865,900

[45] Date of Patent: Sep. 12, 1989

[54] ARTICLE HAVING CONCEALING PATTERN

[76] Inventors: Christopher Shannon, 1 Front Street, Petersfield, Manitoba, Canada, R0C 2L0; Glen A. Heroux, Box 217, Eriksdale, Manitoba, Canada, R0C 0W0

[21] Appl. No.: 115,862

[22] Filed: Nov. 2, 1987

[51] Int. Cl.[4] ..... B32B 3/00

[52] U.S. Cl. ..... 428/195; 428/919

[58] Field of Search ..... 428/195, 919

*Primary Examiner*—James J. Bell

*Attorney, Agent, or Firm*—Robert W. B. Bailey

[57] ABSTRACT

This invention is directed to an article having a surface pattern adapted to conceal in a leafy environment. The pattern is designed to approximate the leafy background, by incorporating colors and shapes typical of the environment in appearance. These shapes are primarily leaf and twig, shapes and colors. The leaf and twig appearance is dappled or mottled by using dark and light variations of twig and leaf, the general background is chosen from a lighter leaf color. In preferred form, autumnal leaf colors are included for use in areas where a fall season occurs, again these are provided in two shades. In an especially preferred form the darker leaf forms and the lighter general background are themselves mottled or dappled. The leafy environment may be woodland, parkland, forest, shrub, scrub, bush, wilderness, bog, jungle, timberland, and includes any environment where there is a substantial proportion of leafy plants. The article is generally an article of clothing or fabric suitable therefor, but it is not restricted thereto, the article can be a hunting bow or other archery hardware, a firearm, or firearm sling, a hunting chair, a hunting blind for game, e.g. ducks, or a tent, a cover for concealing a truck, or a pile of equipment, a portable comfort station, other equipment and apparel-jackets, coats, capes, headgear, trousers and the like.

20 Claims, 2 Drawing Sheets

ARTICLE HAVING CONCEALING PATTERN

This invention relates to an article having a surface pattern, intended to conceal the article in a leafy environment.

The leafy environment may be woodland, parkland, forest, shrub, scrub, bush, wilderness, bog, jungle, timberland, and includes any environment where there is a substantial proportion of leafy plants, these are usually woody leafy plants but are not necessarily so. These occur worldwide, adapted to most climates having annual rainfall greater than 25 centimeters [10 inches]. In general there is little variation of the general type of mix of leafy plants of such leafy environments over wide ranges of latitude, longitude, and altitude, so that a pattern that conceals in one area will usually conceal in a large number of similar areas, even of different climatic type—a pattern that will conceal in the northern North American forest will also conceal in most European woodland, and in similar areas in northern Asia.

The pattern is designed to approximate the leafy background, by incorporating colors and shapes typical of the environment in appearance. These shapes are primarily leafy and twig, shapes and colors.

BACKGROUND OF THE INVENTION

Such concealing patterns were not of great interest before the First World War, although uniforms were often of a color—khaki, horizon blue, field grey, slate green—which blended into the background. Patterns designed to disrupt the outlines of objects, and hiding objects under a fabric having such a pattern, came into general use in the First World War. This use was greatly expanded subsequently. Disruptive patterns were used for apparel in the Second World War. These patterns do not resemble anything in particular, at near and medium distance they are believed to "break up" the image of the object in the human eye, and in the far distance, above about 600 meters [660 yards], they have a generally drab dirty grey, green or brown appearance, which blends into the background.

Hunters' [as opposed to military] camouflage, is more directed to blending into the background, as exemplified by the dark greenish background coloration of the "hunting" tartans of the Scottish Highland Clans (as opposed to the more flamboyant and highly visible "dress" tartans), or drab colored clothing, which does not stand out at a distance. This distinction is attributed to the believed colorblindness of animals, especially game animals, as opposed to the color vision of humans. Nevertheless many hunters wear apparel having disruptive patterns of the military type as specific hunting camouflage is uncommon. A recent development is color schemes resembling treebark for hunting apparel, while this conceals in the far distance and against suitable backgrounds, it does not conceal against unsuitable backgrounds such as greenwood [spring & summer] foliage.

Development of a suitable pattern for concealment in a hunting environment, which is nearly always leafy, requires study of that environment. Due to human activity, there is little primary, temperate or tropical, climax forest with a high leaf canopy, nearly all leafy environment is secondary growth forest resulting from destruction of the primary forest by human related activities. The most typical feature of secondary growth forest is dense undergrowth composed of smaller species of trees, bushes, shrubs, and saplings of larger species of trees, as the forest attempts to reassert itself. This undergrowth is generally very leafy ranging from 1 to 3 meters [3 to 10 feet] in height, and comprises several species of leafy plants, typically forming numerous thickets. In some areas the entire forest is composed of this sort of growth, for instance after a forest fire or logging.

DESCRIPTION OF THE INVENTION

An object of the invention is to provide a pattern, which when placed on an article conceals in a leafy environment due to resemblance of appearance of the pattern to that of the environment.

This article is generally an article of clothing or a fabric suitable therefor, but it is not restricted thereto, the article can be a hunting bow or other archery hardware, a firearm, a firearm sling, a hunting chair, a hunting blind for game, e.g. ducks, or a tent, a cover for concealing a truck, or a pile of equipment, a portable comfort station, other equipment and apparel—jackets, coats, capes, headgear, trousers and the like.

The basic problem is to design a pattern which conceals against this background over distances up to 600 meters [660 yards], any suitable color blend beyond this distance will tend to average the color to drab dirty green, brown or grey, which conceals under most circumstances. In practice only the foliage from ground level to 2 meters [6.6 feet] needs to be considered, as few men and fewer women are greater than 2 meters in height. This is the typical spring and summer hunting environment. While this environment is composed of numerous species of plant, the typical common plant species are fairly standard, and not that numerous, perhaps four or five species. The pattern should incorporate the leaf shape of at least one of these common species. The average color must approximate the foliage color, so the leaf color is selected from color shades darker than average and the background color is selected from color shades lighter than average to balance the overall color. The pattern also must incorporate leaf shaped as well as colors the darker leaf color forming leaflike shapes. The darker color forms a greater surface portion than the lighter color.

As twigs and small branches are present in nature, twiglike patches of color may be present in the pattern. When present these patches are also in two colors to approximate the average twig color, a light color selected from twig colors lighter than average, and a dark color selected from twig colors darker than average. These colors need not match the actual pigment of the leaf or twig, but should approximate lighter colors observed on a bright day, for example pale lime green for a leaf and white for a twig, and darker colors observed on a dull day, say dark bottle green for a leaf, and dark brown for a twig. The area of the twiglike patches light and dark together forms a minor area of the pattern, less than the background light leaf color, with the lighter twiglike areas forming a lesser portion of the surface than the darker. This combination is suitable for spring and summer style hunting or areas, where there is no fall, for example tropical rain forests. The pattern cannot be composed of the average shade of leaf and twig as this will stand out against the mottled or dappled leafy background, thus the pattern must itself be dappled in appearance with respect to both leaf and twig, thus some of each should be lighter than average in color, and some darker.

In areas where there is a fall, this must be taken into account in pattern design. This is taken into account by providing two extra styles of patch, both having a general non-specific leaf shape, one having a color darker than the average unfallen autumnal leaf, this color in practice can approximate that of the darker twig shade, the other having a color lighter than the average unfallen autumnal leaf. Taken together these patches approximate the average autumnal leaf color. This variation of the pattern can be used areas where there is a fall, in spring, summer, and fall, and where there is little or no lying snow, in the winter.

It is a further object of the invention to provide articles having a surface pattern, which will conceal in a leafy environment, for as much as possible of the year, and preferably all year long.

The invention in a broad aspect is an article having a surface pattern adapted for concealment in a leafy environment, wherein the pattern comprises a first color selected from the group consisting of colors having hues in the range of 10Y and 10BG, values in the range of 2 to 5 and chromas greater than 2, a second color selected from the group consisting of colors having hues in the range of 10Y to 5BG, values in the range of 6 to 9, and chromas greater than 2, the first color forming demarcated areas having shapes of generally biconvex curvilinear outline, the first color comprising a major portion of the surface pattern, the second color forming a background portion of the surface pattern, the second color comprising a minor portion of the surface pattern. The pattern may additionally comprise a third color selected from the group consisting of colors having hues in the range of 10Y to 5RP, values in the range of 0 to 5 and chromas less than 10, forming demarcated elongated areas of strip form, a fourth color selected from the group consisting of colors having no hue restriction, chromas of less than 3, and values greater than 8, forming demarcated elongated areas of strip form, the third color comprising a substantially lesser portion of the surface pattern than the second color, and the fourth color comprising a lesser proportion of the surface pattern than the third color. More preferably the pattern additionally comprises demarcated areas having a generally curvilinear outline of the third color, and a fifth color selected from the group consisting of colors having hues in the range 10Y and 10P, values in the range of 5 to 9, and chromas greater than 3, the fifth color comprising demarcated areas having a generally curvilinear outline, the demarcated areas having a generally curvilinear outline of the third color having a surface portion not greater than of the second color, the fifth color having a surface portion not greater than the demarcated areas having a generally curvilinear outline of the third color, the demarcated elongated areas of strip form of the third color having a substantially lesser surface portion than the fifth color, and the fourth color having a substantially lesser surface portion than the demarcated elongated areas of strip form of the third color, the third color both demarcated elongated areas of strip form and demarcated areas having a generally curvilinear outline taken together comprising a surface area not substantially greater than the second color. More preferably the first color is selected from the group consisting of colors having hues in the range of 5GY to 10G, values in the range of 3 to 5 and chromas greater than 4, the second color is selected from the group consisting of color having hues in the range of 10Y to 5G, values in the range of 5 to 8, and chromas greater than 3, the third color is selected from the group consisting of colors having hues in the range of 5Y to 10RP, values in the range of 2 to 4, and chromas less than 8, the fourth color is selected from the group consisting of colors having no hue restriction, values greater than 9, and chromas less than 2, the fifth color is selected from the group consisting of colors having hues in the range of 10Y to 10P, values in the range of 6 to 8, and chromas in the range of greater than 4 to less than 10. The article in preferred form is a fabric, generally of the type suitable for apparel, although heavier and lighter fabrics may be so patterned.

In preferred applications the first color is dark green, the second color is light yellow green, the third color is dark brown, the fourth color is white and the fifth color is pinkish.

In an especially preferred embodiment the "demarcated areas having shapes of generally biconvex curvilinear outline are preferably" are selected from the group consisting of specific leaf forms of dominant leafy plant species of the leafy environment as would be understood by those skilled in the art.

The phrase—demarcated areas having shapes of generally biconvex curvilinear outline—generally defines many leaf specific shapes. The phrase—demarcated elongated areas of strip form—describes twiglike areas. The phase—demarcated areas having a generally curvilinear outline—defines shapes generally resembling leaves.

In an especially preferred variation the shaped areas of dark green color, and the light yellow green background areas each comprise smaller areas of darker shade in continuous areas of lighter shade.

In a similar preferred embodiment the dark brown demarcated areas having a generally curvilinear outline comprise smaller areas of darker shade in continuous areas of lighter shade.

The article, in preferred form, is selected from the group consisting of articles of clothing, fabric suitable for clothing, hunting equipment, blinds, tents, concealing covers, portable comfort stations and the like.

The fabric, in preferred form is an article of apparel selected from the group consisting of hats, jackets, coats, trousers, capes, cloaks, shirts, shorts, caps, socks, boots, shoes, and habits and the like.

The ranges for each color are generally indicated under the definitions of ASTM D 1535-80, the first color is generally between limits of hue 10Y and 10BG, values of 2 to 5 and chroma greater than 2, as recognized by those skilled in the art some of these colors are more suitable than others, while others outside these limits could be substituted e.g. some 5B hues could be utilised. In preferred and common use the range of first color would be more restricted to hues from 5GY to 10G, to values of 3 to 5 and chromas greater than 4 or even 5. The second color is of similar hue from 10Y to 5BG, values between 6 and 9, and chroma greater than 2, again in preferred form the hue is between 10Y and 5G, the value from 6 to 8, the chroma greater than 3. The third color can have hues from 10Y to 5RP, values from 0 to 5 and generally chroma less than 10, i.e. The color is not generally "vivid", "strong", or "deep" but rather "dark" or "dull", in preferred form the hue range is 5Y to 10RP, the value 2 to 4, and the chroma less than 8. The fourth color is essentially tinged white having no hue restriction, chroma of less than 3, and value greater than 8, in preferred form this is white—no hue restriction, value greater than 9, chroma less than 2. The fifth color is of hue between 10Y and 10P of value 5 to 9 and of chroma greater than 3, in preferred form the chroma is greater than 4 and less than 10, and the value from 6 to 8. These color descriptions should be regarded as general guidelines, the colors used must fit the environment concerned, and may in some cases lie outside the indicated ranges. The overlaps of color range would not mean in practice that the colors can be identical. The terms "substantially darker" and "substantially lighter" mean that there is a clear color distinction beyond debate, and usually with at least one or more chroma or value difference. Those skilled in the art will recognise that many variations are possible within the colors indicated.

DESCRIPTION OF PREFERRED EMBODIMENTS

Preferred embodiments are described as indicated in the drawings, where

Figure 1:
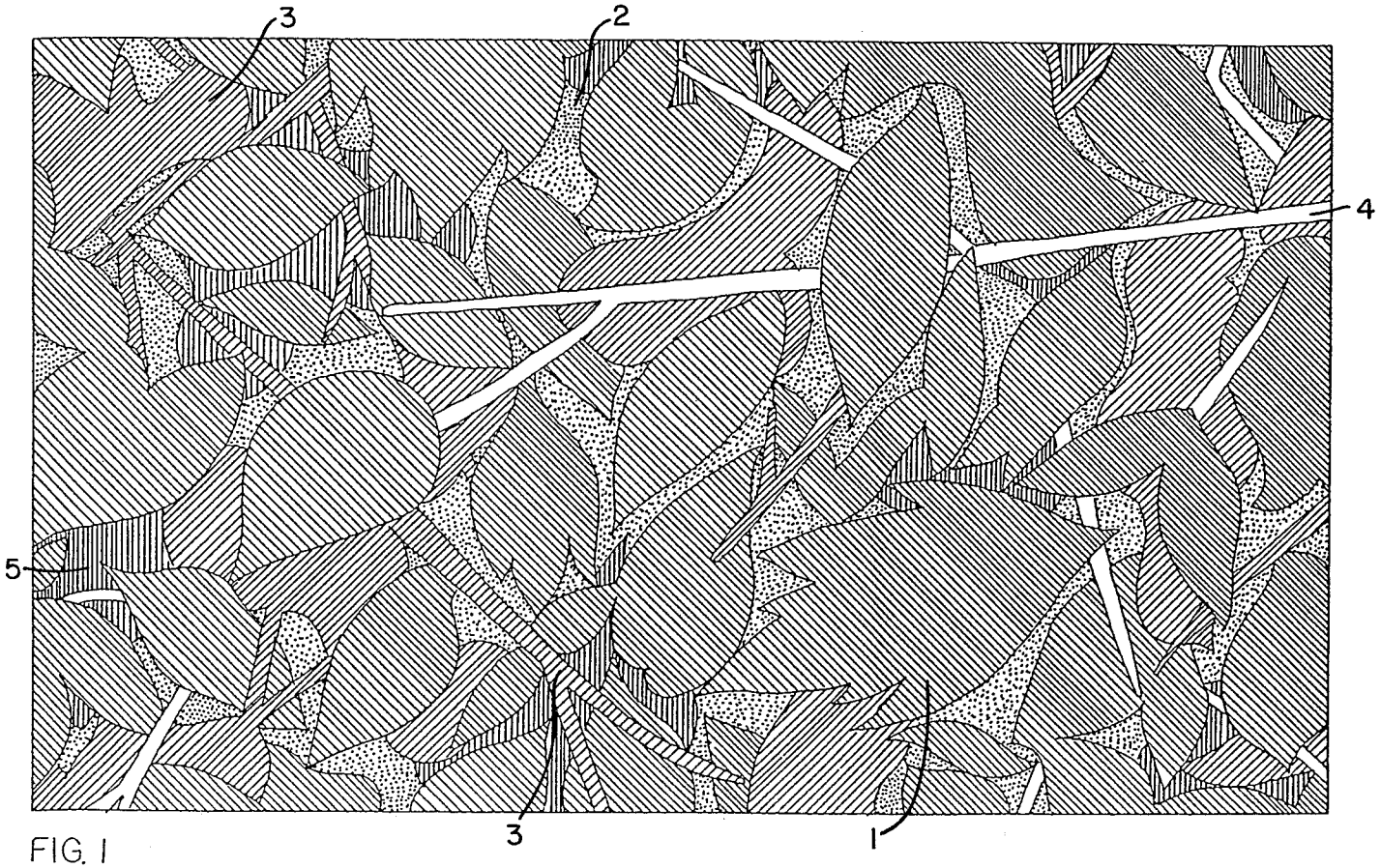
FIG. 1 is a reduced representation of a fragment of a form of the pattern.
Figure 2:
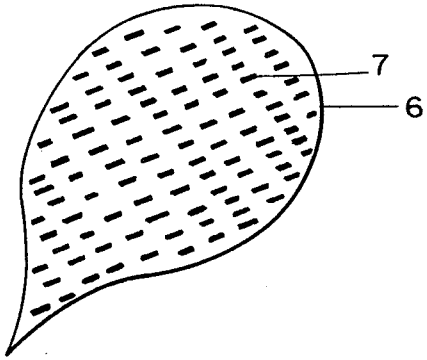
FIG. 2 is a representation of a preferred form of a leaf of the pattern.

In FIG. 1, the numeral 1 indicates the first color, a darkish green, these leaf forms are apparently largely in the foreground of the pattern and are selected from leaf forms typical of secondary growth in southern Manitoba, which represents the darker spring/summer leaves, the numeral 2 indicates the second color, a light yellow green, forming the residual general background, and having no specific shape, the numeral 3 indicates the third color, a darkish brown, forming strips and areas of general (non-specific) leaf form, which represents darker twigs and darker autumnal leaves, these tend to appear in the middle ground, the numeral 4 indicates the fourth color, white, forming strips and representing lighter twigs and light reflections, the numeral 5 indicates the fifth color, pinkish, forming areas of general (non-specific) leaf form, apparently in the further middle ground. FIG. 2, indicates a leaf form (of color 1) having a pattern to represent the effect of leaf wax on reflection, the leaf form has a lighter background 6 (shown as white for clarity) with aligned rows of small darker elliptical patches 7 (shown as black for clarity), roughly perpendicular to its apparent longitudinal axis. While this is shown on a leaf of color 1, in a preferred form it may be applied to the general leaf forms of colors 3, and 5 and background area color 2.

Although this invention is described in terms of specific embodiments, it is not limited thereto, as would be understood by those skilled in the art, numerous variations are possible within the scope of the invention, without departing from the scope and nature thereof.

We claim:

1. An article having a surface pattern adapted for concealment in a leafy environment, wherein said pattern comprises a first color selected from the group consisting of colors having hues in the range of 10Y and 10BG, values in the range of 2 to 5 and chromas greater than 2, a second color selected from the group consisting of colors having hues in the range of 10Y to 5BG, values in the range of 6 and 9, and chromas greater than 2, said first color forming demarcated areas having shapes of generally biconvex curvilinear outline, said first color comprising a major portion of the surface pattern, said second color forming a background portion of the surface pattern, said second color comprising a minor portion of said surface pattern.

2. The article of claim 1, wherein said pattern additionally comprises a third color selected from the group consisting of colors having hues in the range of 10Y to 5RP, values in the range of 0 to 5 and chromas less than 10, forming demarcated elongated areas of strip form, a fourth color selected from the group consisting of colors having no hue restriction, chromas of less than 3, and values greater than 8, forming demarcated elongated areas of strip form, said third color comprising substantially lesser portion of the surface pattern than the second color, and said fourth color comprising a lesser proportion of the surface pattern than said third color.

3. The article of claim 2, wherein said pattern additionally comprises demarcated areas having a generally curvilinear outline of the third color, and a fifth color selected from the group consisting of colors having hues in the range 10Y and 10P, values in the range of 5 to 9, and chromas greater than 3, said fifth color comprising demarcated areas having a generally curvilinear outline, said demarcated areas having a generally curvilinear outline of said third color having a surface portion not greater than of said second color, said fifth color having a surface portion not greater than said demarcated areas having a generally curvilinear outline of said third color, said demarcated elongated areas of strip form of said third color having a substantially lesser surface portion than said fifth color, and said fourth color having a substantially lesser surface portion than said demarcated elongated areas of strip form of said third color, said third color both demarcated elongated areas of strip form and said demarcated areas having a generally curvilinear outline taken together comprising a surface area not substantially greater than said second color.

4. The article of claim 1, wherein said first color is selected from the group consisting of colors having hues in the range of 5GY to 10G, values in the range of 3 to 5 and chromas greater than 4, said second color is selected from the group consisting of colors having hues in the range of 10Y to 5G, values in the range of 6 to 8, and chromas greater than 3.

5. The article of claim 2, wherein said first color is selected from the group consisting of colors having hues in the range of 5GY to 10G, values in the range of 3 to 5 and chromas greater than 4, said second color is selected from the group consisting of colors having hues in the range of 10Y to 5G, values in the range of 6 to 8, and chromas greater than 3, said third color is selected from the group consisting of colors having hues in the range of 5Y to 10RP, values in the range of 2 to 4, and chromas less than 8, said fourth color is selected from the group consisting of colors having no hue restriction, values greater than 9, and chromas less than 2.

6. The article of claim 3, wherein said first color is selected from the group consisting of colors having hues in the range of 5GY to 10G, values in the range of 3 to 5 and chromas greater than 4, said second color is selected from the group consisting of colors having hues in the range of 10Y to 5G, values in the range of 6 to 8, and chromas greater than 3, said third color is selected from the group consisting of colors having hues in the range of 5Y to 10RP, values in the range of 2 to 4, and chromas less than 8, said fourth color is selected from the group consisting of colors having no hue restriction, values greater than 9, and chromas less than 2, and said fifth color is selected from the group consisting of colors having hues in the range of 10Y to 10P, values in the range of 6 to 8, and chromas in the range of greater than 4 to less than 10.

7. The article of claim 1, wherein said first color is dark green, said second color is light yellow green.

8. The article of claim 2, wherein said first color is dark green, said second color is light yellow green said third color is dark brown, said fourth color is white.

9. The article of claim 3, wherein said first color is dark green, said second color is light yellow green, said third color is dark brown, said fourth color is white, and said fifth color is pinkish.

10. The article of claim 7, wherein said areas of dark green color, and said light yellow green background areas each comprise smaller areas of darker shade in continuous areas of lighter shade.

11. The article of claim 8, wherein said areas of dark green color, and said light yellow green background areas each comprise smaller areas of darker shade in continuous areas of lighter shade.

12. The article of claim 9, wherein said areas of dark green color, and said light yellow green background areas each comprise smaller areas of darker shade in continuous areas of lighter shade.

13. The article of claim 12, wherein said dark brown demarcated areas having a generally curvilinear outline comprise smaller areas of darker shade in continuous areas of lighter shade.

14. The article of claim 3, wherein said article is selected from the group consisting of articles of clothing, fabric suitable for clothing, hunting equipment, blinds, tents, concealing covers, portable comfort stations.

15. A fabric having a surface pattern adapted for concealment in a leafy environment, wherein said pattern comprises a first color selected from the group consisting of colors having hues in the range of 10Y and 10BG, values in the range of 2 to 5 and chromas greater than 2, said first color forming demarcated areas having shapes of generally biconvex curvilinear outline, a second color selected from the group consisting of colors having hues in the range of 10Y to 5BG, values in the range of 6 and 9, and chromas greater than 2, said second color forming a background portion of said surface pattern, third color selected from the group consisting colors having hues in the range of 10Y to 5RP, values in the range of 0 to 5 and chromas less than 10, forming demarcated elongated areas of strip form and demarcated areas having a generally curvilinear outline, a fourth color selected from the group consisting of colors having no hue restriction, chromas of less than 3, and values greater than 8, forming demarcated elongated areas of strip form, and a fifth color selected from the group consisting of colors having hues in the range 10Y and 10P, values in the range of 5 to 9, and chromas greater than 3, said fifth color comprising demarcated areas having a generally curvilinear outline, said first color comprising a major portion of the surface pattern, said second color comprising a minor portion of said surface pattern, said demarcated areas having a generally curvilinear outline of said third color having a surface portion not greater than of said second color, said fifth color having a surface portion not greater than that of said demarcated areas having a generally curvilinear outline of said third color, said demarcated elongated areas of strip form of said third color having a substantially lesser surface portion than said fifth color, said fourth color comprising a lesser proportion of the surface pattern than said demarcated elongated areas of strip form of the third color, said third color both demarcated elongated areas of strip form and demarcated areas having a generally curvilinear outline taken together comprising a surface area not substantially greater than said second color.

16. The fabric of claim 15, wherein said first color is selected from the group consisting of colors having hues in the range of 5GY to 10G, values in the range of 3 to 5 and chromas greater than 4, said second color is selected from the group consisting of colors having hues in the range of 10Y to 5G, values in the range of 6 to 8, and chromas greater than 3, said third color is selected from the group consisting of colors having hues in the range of 5Y to 10RP, values in the range of 2 to 4, and chromas less than 8, said fourth color is selected from the group consisting of colors having no hue restriction, values greater than 9, and chromas less than 2, and said fifth color is selected from the group consisting of colors having hues in the range of 10Y to 10P, values in the range of 6 to 8, and chromas in the range of greater than 4 to less than 10.

17. The fabric of claim 15, wherein said fabric is an article of apparel selected from the group consisting of hats, jackets, coats, trousers, capes, cloaks, shirts, shorts, caps, socks, boots, shoes, and habits.

18. A fabric having a surface pattern adapted for concealment in a leafy environment, wherein said pattern comprises a dark green color forming demarcated areas having shapes of generally biconvex curvilinear outline, a light yellow green color forming the general background of the pattern, a dark brown color forming demarcated elongated areas of strip form and demarcated areas having a generally curvilinear outline, a white color forming demarcated elongated areas of strip form, and a pinkish color forming demarcated areas having a generally curvilinear outline, said dark green comprising a major portion of the surface pattern, said light yellow green comprising a minor portion of said surface pattern, said dark brown demarcated areas having a generally curvilinear outline having a surface portion not greater than said light yellow green, said pinkish color having a surface portion not greater than said dark brown demarcated areas having a generally curvilinear outline, said dark brown demarcated elongated areas of strip form having a substantially lesser surface portion than said pinkish color, said white color comprising a lesser proportion of the surface pattern than said dark brown demarcated elongated areas of strip form, said dark brown demarcated elongated areas of strip form and demarcated areas having a generally curvilinear outline taken together comprising a surface area not substantially greater than said light yellow green.

19. The fabric of claim 18, wherein said areas of dark green color, and said light yellow green background areas each comprise smaller areas of darker shade in continuous areas of lighter shade.

20. The fabric of claim 19, wherein said dark brown demarcated areas having a generally curvilinear outline comprise smaller areas of darker shade in continuous areas of lighter shade.

* * * * *